US005401030A

United States Patent [19]

Halliburton

[11] Patent Number: 5,401,030

[45] Date of Patent: Mar. 28, 1995

[54] GOLF PRACTICE DEVICE

[76] Inventor: Ronald Halliburton, 2029 N. Dixie Hwy., Pompano Beach, Fla. 33060

[21] Appl. No.: 94,434

[22] Filed: Jul. 21, 1993

Related U.S. Application Data

[63] Continuation-in-part of Ser. No. 898,726, Jun. 15, 1992, abandoned.

[51] Int. Cl.[6] ..... A63B 69/36
[52] U.S. Cl. ..... 273/186.3
[58] Field of Search ..... 273/186.3, 186.2

[56] References Cited

U.S. PATENT DOCUMENTS 2,787,470 4/1957 Barrus et al. ..... 273/186.3
3,106,403 10/1963 Kirkman ..... 273/186.3
3,191,939 6/1965 Hooper ..... 273/186.3

FOREIGN PATENT DOCUMENTS 2110095 6/1983 United Kingdom ..... 273/186.3

*Primary Examiner*—George J. Marlo
*Attorney, Agent, or Firm*—Oltman and Flynn

[57] ABSTRACT

A golf practice device for attachment to a golf club having a club head and a shaft, includes a swing speed-sensing device and a direction indicating device attached to the shaft. The swing direction indicating device is coupled to the swing speed-sensing device for indicating a swing speed set to given speed value. A light emitter provided in the swing speed indicating device is activated by different inertial masses and indicates with a light trace of a visible light beam directed at the golf player's eyes a swing speed reaching the given speed value, and the direction of the club head compared with a line on the ground. Two light emitters positioned in line with the swing direction can be provided to indicate if the club head is swung squarely in the swing direction.

15 Claims, 6 Drawing Sheets

ESTIMATED YARDAGES & SPEEDS

| APPROX * CLUBHEAD SPEEDS | INSERTS | WEDGE | 9 IRON | 8 IRON | 7 IRON | 6 IRON | 5 IRON | 4 IRON | 3 IRON | 2 IRON | DRIVER |
|---|---|---|---|---|---|---|---|---|---|---|---|
| 41 MPH | 1 | 60 | 70 | 80 | 90 | 100 | 110 | 120 | 130 | 140 | 170 |
| 44 MPH | 2 | 70 | 80 | 90 | 100 | 110 | 120 | 130 | 140 | 150 | 180 |
| 47 MPH | 3 | 80 | 90 | 100 | 110 | 120 | 130 | 140 | 150 | 160 | 190 |
| 50 MPH | 4 | 90 | 100 | 110 | 120 | 130 | 140 | 150 | 160 | 170 | 200 |
| 54 MPH | 5 | 100 | 110 | 120 | 130 | 140 | 150 | 160 | 170 | 180 | 210 |
| 58 MPH | 6 | 110 | 120 | 130 | 140 | 150 | 160 | 170 | 180 | 190 | 220 |
| 64 MPH | 7 | 120 | 130 | 140 | 150 | 160 | 170 | 180 | 190 | 200 | 230 |
| 72 MPH | 8 | 130 | 140 | 150 | 160 | 170 | 180 | 190 | 200 | 210 | 240 |
| 86 MPH | 9 | 140 | 150 | 160 | 170 | 180 | 190 | 200 | 210 | 220 | 250 |
| | GORILLA | 150+ | 160+ | 170+ | 180+ | 190+ | 200+ | 210+ | 220+ | 230+ | ? |

*LIGHT WILL TURN ON APPROXIMATELY 12 INCHES BEFORE IMPACT POINT.

5
5
21
27
22
16
19
29
28
31
26
7
18'
13'
13"
23
32
6
36
14
9
38
8
37
34
33

18"
18

ESTIMATED YARDAGES & SPEEDS

| APPROX * CLUBHEAD SPEEDS | INSERTS | WEDGE | 9 IRON | 8 IRON | 7 IRON | 6 IRON | 5 IRON | 4 IRON | 3 IRON | 2 IRON | DRIVER |
|---|---|---|---|---|---|---|---|---|---|---|---|
| 41 MPH | 1 | 60 | 70 | 80 | 90 | 100 | 110 | 120 | 130 | 140 | 170 |
| 44 MPH | 2 | 70 | 80 | 90 | 100 | 110 | 120 | 130 | 140 | 150 | 180 |
| 47 MPH | 3 | 80 | 90 | 100 | 110 | 120 | 130 | 140 | 150 | 160 | 190 |
| 50 MPH | 4 | 90 | 100 | 110 | 120 | 130 | 140 | 150 | 160 | 170 | 200 |
| 54 MPH | 5 | 100 | 110 | 120 | 130 | 140 | 150 | 160 | 170 | 180 | 210 |
| 58 MPH | 6 | 110 | 120 | 130 | 140 | 150 | 160 | 170 | 180 | 190 | 220 |
| 64 MPH | 7 | 120 | 130 | 140 | 150 | 160 | 170 | 180 | 190 | 200 | 230 |
| 72 MPH | 8 | 130 | 140 | 150 | 160 | 170 | 180 | 190 | 200 | 210 | 240 |
| 86 MPH | 9 | 140 | 150 | 160 | 170 | 180 | 190 | 200 | 210 | 220 | 250 |
| | GORILLA | 150+ | 160+ | 170+ | 180+ | 190+ | 200+ | 210+ | 220+ | 230+ | ? |

*LIGHT WILL TURN ON APPROXIMATELY 12 INCHES BEFORE IMPACT POINT.

FIG. 8

GOLF PRACTICE DEVICE

This is a continuation-in-part of application Ser. No. 07/898,726, filed Jun.15, 1992, now abandoned.

The invention relates to a golf practice device in the form of a speed-sensing and direction indicating device attached to the golf club, a switch connected to the speed-sensing device, a light emitter on the club head connected to the switch and an inertial mass engaging the switch so that a light is emitted and visible to the player when the speed of the golf club is within the proper range for reaching a target.

BACKGROUND OF THE INVENTION

In order to attain good playing performance it is important for a golf player to be able to moderate the speed and adjust the direction of the golf club head so as to hit the ball with a speed and direction that best serves to hit the selected target.

Inventors have in the past proposed speed-sensing devices connected to a golf club that can aid a player in developing skills in applying the best form of impact to the ball.

U.S. Pat. No. 3,792,863 discloses a golf club equipped with an accelerometer in the club head, a torque strain gauge in the shaft and a flex strain gauge also in the shaft, all connected to an FM transmitter in the shaft which communicates with the FM receiver with appropriate recording and display devices to show the player the applied amount of force, etc. for best performance. U.S. Pat. No. 3,945,646 shows a system of somewhat similar construction. U.S. Pat. No. 5,040,790 shows an apparatus for training a player in the pacing of the swing by means of a device that generates tones of different pitch related to the pacing of the swing of the club.

The devices of the known art, however, suffer from being of considerable complexity and bulkiness, which is a serious drawback for many players who wish to essentially practice the speed and direction of the swing at any suitable practice location. The instant invention is directed to overcome this problem in that it is compact, and easy to use.

SUMMARY OF THE INVENTION

According to the invention there is provided a golf practice device for attachment to a golf club having a club head and a shaft comprising swing speed-sensing and direction indicating means attached to the shaft, the swing speed indicating means being coupled to the swing speed-sensing means for indicating a swing speed set to given speed value, a light emitter in the swing speed sensing means for directing a visible light beam at the golf player's eyes in response to a swing speed attaining the given speed value.

According to a further feature, the golf practice device includes in the swing speed-sensing and direction indicating means a centrifugal force switch coupled to the swing speed indicating means.

The golf practice device may indicate to the golfer the actual clubhead speed (and corresponding distance). This is accomplished by the golfer observing where in the swing path the light is activated. A proper swing at the desired swing speed will actuate the light at the bottom of the swing arc. The various swing speed inserts are calibrated to initiate the contacts in response to pre-determined levels of centrifugal force that in turn translates to various swing speed.

According to a further feature, the golf practice device includes in the centrifugal force switch at least one inertial mass, an electric snap switch in engagement with the inertial mass, and an electric power source coupled to the light emitter via the electric snap switch for energizing the light emitter upon closure of the electric snap switch.

According to still another feature, the golf practice device includes a front and a back side of the golf club head, the front side having a sweet spot, the light emitter disposed at the back side of the head in alignment with the sweet spot, further including a high-density light-emitting diode in the light emitter, and optionally including a red high-intensity light-emitting diode in the light emitter.

The golf club practice device may further include detachable attachment means in the swing speed-sensing and direction indicating means for detachably attaching the swing speed-sensing and direction indicating means to the shaft. The attaching means may advantageously have a resilient two-prong clip in the detachable attachment means for resiliently receiving the shaft in the resilient two-prong clip.

The golf practice device may additionally include adjusting means in the swing speed-sensing means for adjusting the indicated speed value, for example in the form of a plurality of exchangeable differently weighted inertia masses in the centrifugal force switch for adjusting the indicated swing speed value.

The direction indicating means may include a mat having a line marked thereon which indicates the desired direction of the swing and which the player seeks to align with the light trace created by the light indicator during the swing.

Further objects and advantages of this invention will be apparent from the following detailed description of a presently preferred embodiment which is illustrated schematically in the accompanying drawings.

BRIEF DESCRIPTION OF THE DRAWINGS

FIG. 8 is a table showing the centrifugal force in grams for different masses of respective inserts and for different speeds and different clubs;

FIG. **9*a* is a fragmentary detail view showing a club head with two in-line light emitters.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DESCRIPTION OF THE PREFERRED EMBODIMENTS

Figure 1:
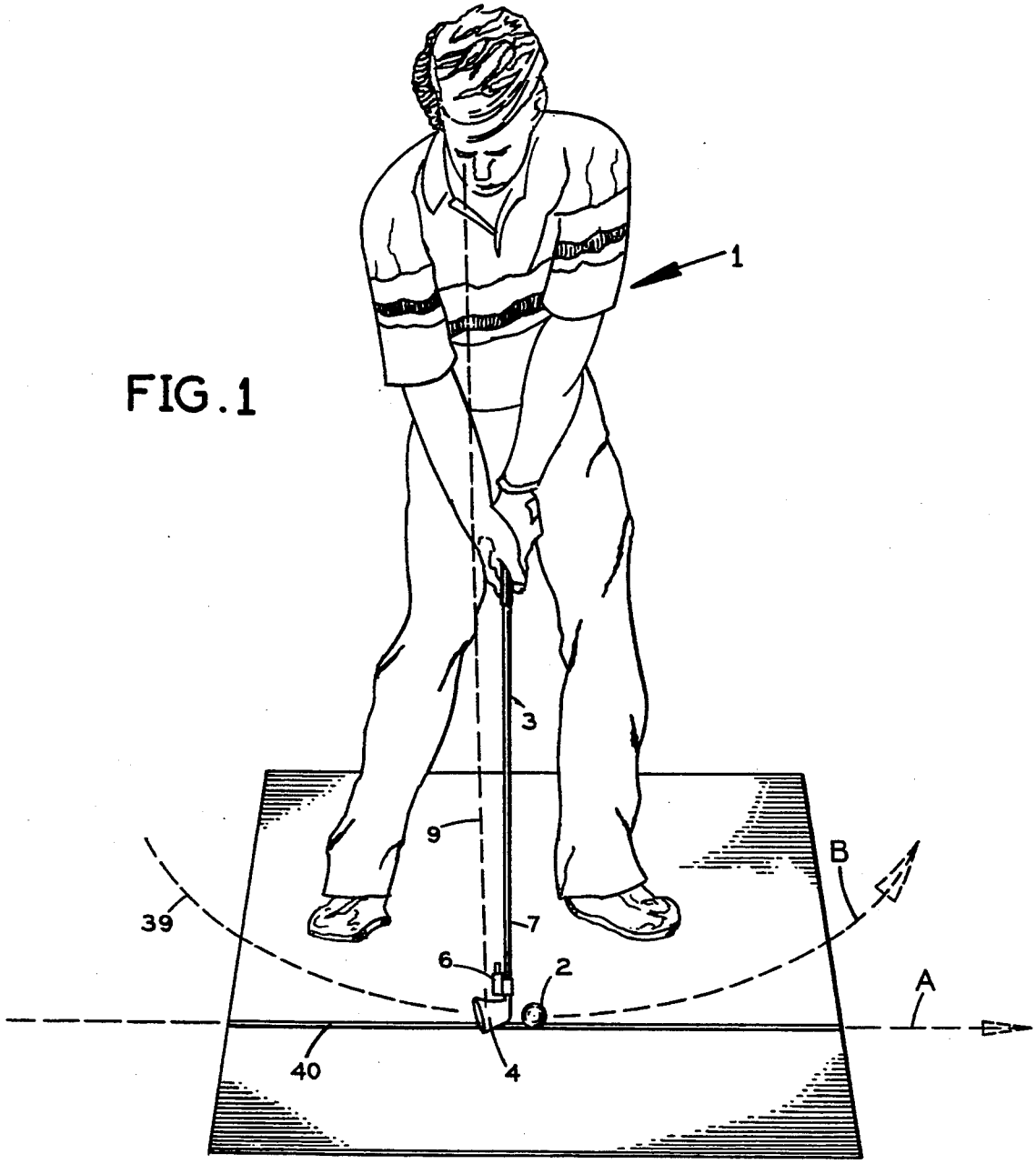
FIG. 1 is a view showing a golf player with the invention attached to a golf club.

In FIG. 1 a golf player 1 is shown in a stance on a mat 41 swinging a golf club 3 at a tee 2 or a simulated golf ball, aiming the ball on the mat in the direction indicated by arrow A which is an extension of a target line 40 marked on the mat 41 following the desired direction of the swing. The club head 4 follows a generally arcuate trajectory indicated by arrow B.

The golf training device 6 is attached to the lower part 7 of the shaft of the golf club 3. The training device 6 has an internal speed-sensing and direction indicating arrangement that activates a light emitter aligned over the back side of the club head 4 which indicates by its light emission if the player is swinging the golf club at the proper speed and direction. The light emitter shown by reference numeral 8 in FIG. 2 is focused so that it sends a beam of light toward the eyes of the player as indicated by light beam 9, that is sensed by the player during the swing as a line or trace of light indicating direction of the swing.

Figure 2:
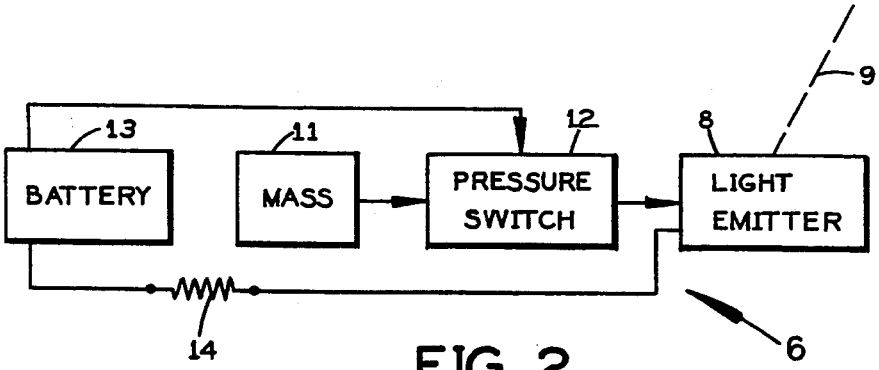
FIG. 2 is a block diagram showing the basic elements of the invention.

FIG. 2 is a simplified block diagram of the invention showing the basic parts of the invention, which include the light emitter 8 connected to a pressure switch 12 that closes a pair of contacts, that in engagement with an inertial mass 11 acts on the switch 12 when the speed of the swing is of the right magnitude. A battery 13 is connected to the light emitter 8 when the pressure switch is closed and activates the light emitter 8. Depending upon the type of light emitter, a resistor 14 in series in the light circuit serves to limit the light current to a safe value for the light emitter 8.

Figure 3:
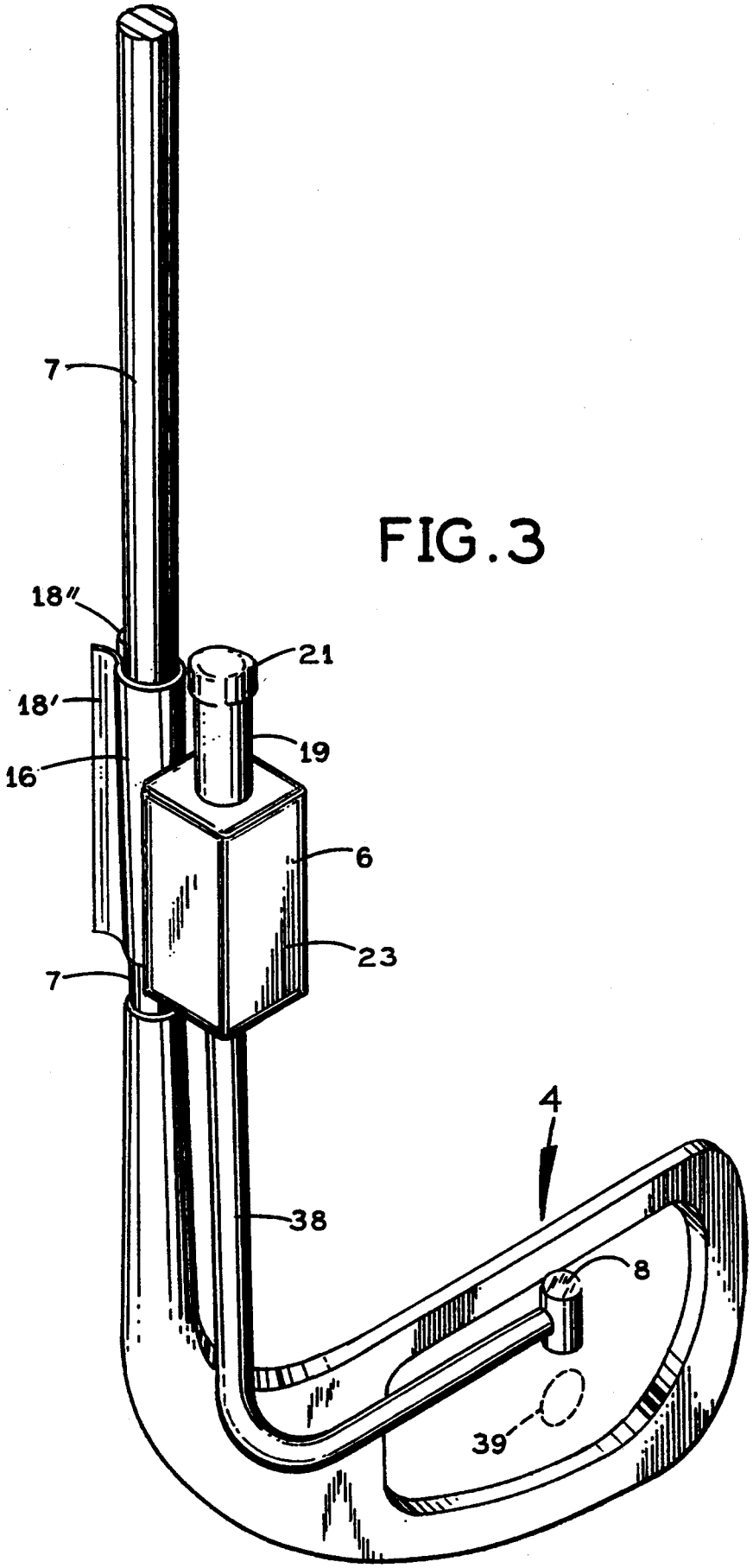
FIG. 3 is a fragmentary enlarged detail view of the invention showing it attached to a golf club.

FIG. 3 is a fragmentary elevational view of the invention showing the lower part 7 of the shaft of the golf club. The head 4 of the golf club is seen from its back side with the forward facing drive side facing away from the viewer. The golf practice device 6 is attached to the lower part of the shaft 7 by means of a detachable clip 16, shown in cross-section in FIG. 5 which has two resilient prongs 18', 18'' that resiliently grip the lower part 7 of the shaft.

Figures 4, 5, 6:
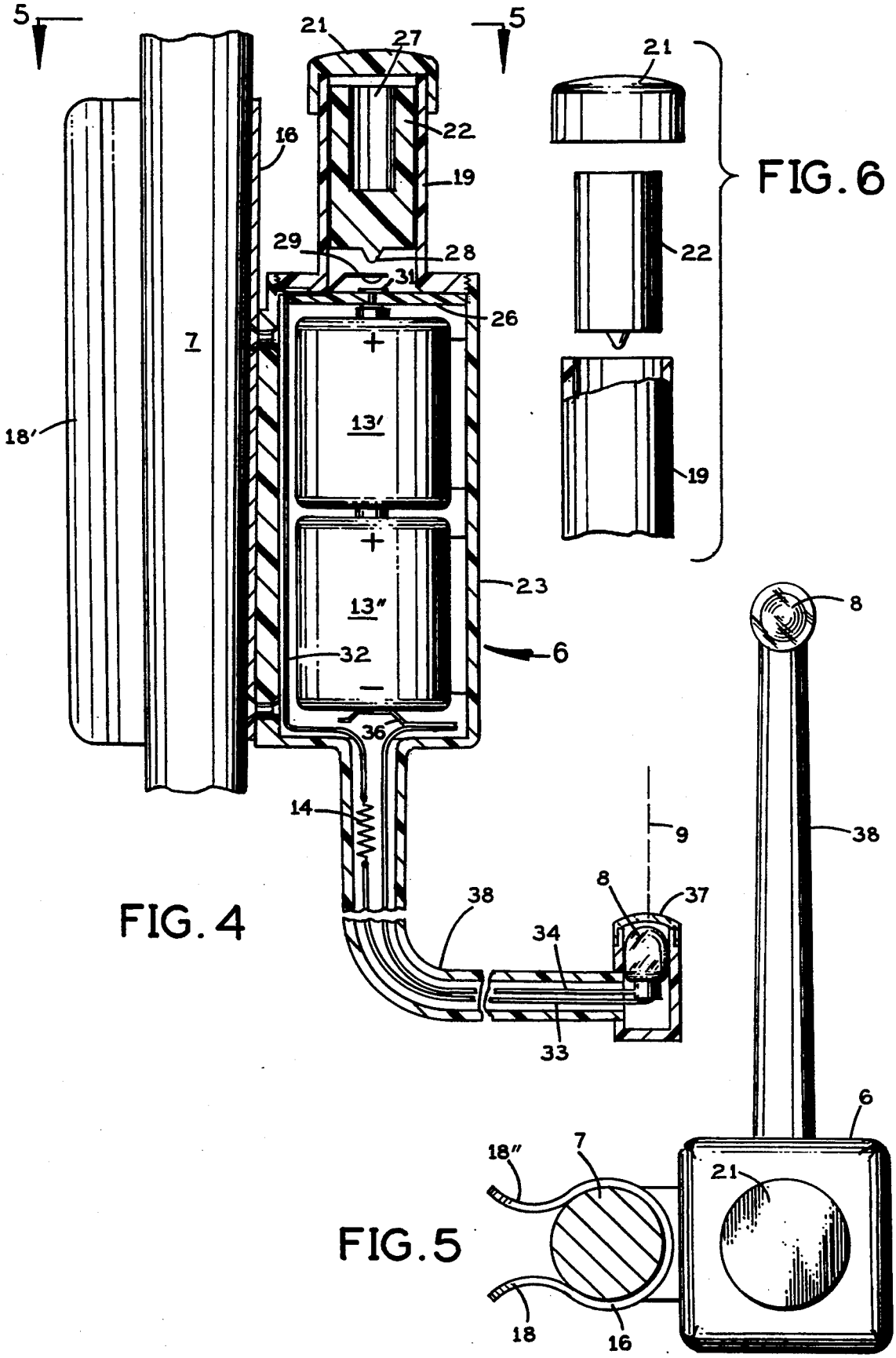
FIG. 4 is a cross-sectional fragmentary view of the invention showing the internal construction.
FIG. 5 is a plan view of the invention seen along the line 5—5 of FIG. 4.
FIG. 6 is a view showing the cap and inertial mass removed from the tubular member.

The training device 6 (FIG. 3) has an upper tubular part 19 that is upwardly closed by a detachable cap 21, and enclosing a vertically slidable inertial mass 22, seen in FIGS. 4 and 6. A lower housing 23 encloses batteries and switches as seen in more detail in FIG. 4.

FIG. 4 is a cross-sectional elevational view showing the inertial mass 22 vertically slidable in the tubular part 19, During a swing with the golf club the centrifugal force of the swing urges the mass 22 downward with a force F depending on the speed of the swing according to the formula $F=mv^2/R$ wherein m is equal to the mass of the inertial mass 22, v is the speed of the golf club head during the swing and R is the radius of the circle describing the trajectory of the golf club head 4.

It follows that the speed v of the swing is determined by $v=\sqrt{FR/m}$, wherein the variables v, F,R and m can be expressed in any system of measures.

Figure 7:
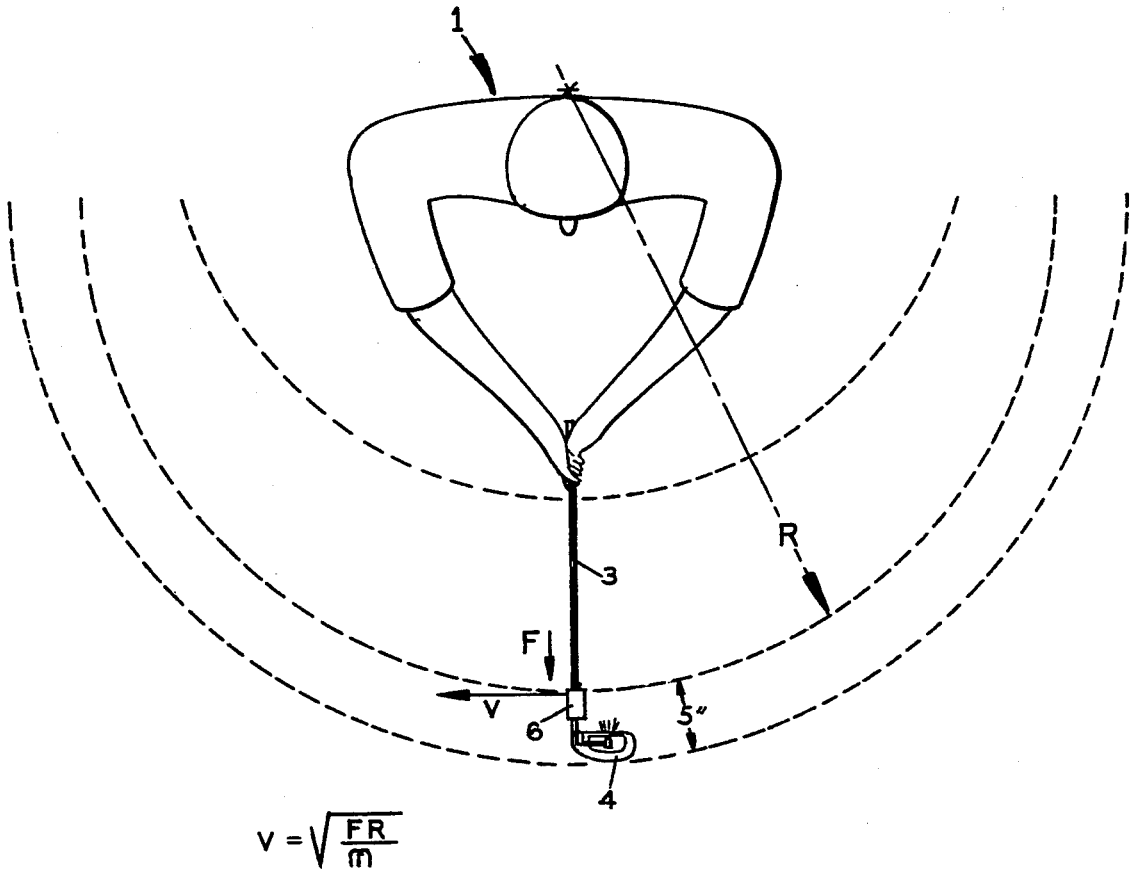
FIG. 7 is a top-down view showing the player in the middle of a swing with the club, and various distances and speeds as they relate to the description of FIG. 7.

In FIG. 7 a player 1 is shown in a top-down view, swinging a club 3, wherein the mass m, i.e. mass of the inertial mass 22, is swung in a circle having a radius R. The club head is shown extending a distance of approximately 5 inches beyond the radius R.

The different inertial masses are calibrated so that the light 8 is turned on at the bottom of the swing arc at predetermined club head swing speeds. These swing speeds have been selected so that they correspond to ten yard increments, in range, i.e. yardage, of the ball for different clubs, ranging from wedge, through irons Nos. 9-2 and a driver as shown in the table FIG. 8. For example, at a swing speed of 50 miles per hour (mph), using insert #4, a No. 5 iron will yield a range of 140 yards. If the swing speed is too low, the light will not turn on; if the swing speed is too fast, the light will turn on in advance of the point of impact with the ball, and will stay on through an extended arc of the swing. If the swing speed is correct, the light will turn on at or just before the point of impact, and will stay on for an extended arc of the swing.

The inertial mass 22 can be constructed with different weights by means of filling a hole 27 bored into the mass. By decreasing the size of the weight in the hole 27 the weight of the inertial mass 22 is degreased, and a greater swinging speed is required for the mass 22 to overcome the force of switch contacts 29,31. The switch contacts 29,31 are advantageously formed as snap switch contacts, as known from conventional snap switches. Inertial masses if different weights can be inserted by removing a cap 21 on top of the tubular part 19 and inserting a lighter or heavier mass 22 as desired.

During a swing of proper speed the inertial mass 22, having a downward facing point 28, engages the moving contact 29 and bends it downward with a snap action to make electrical contact with a fixed contact 31 inserted in the cross plate 26, at a force of e.g. 130 g. When the two contacts 29,31 make electrical contact during a swing of sufficient speed, an electrical circuit is closed through series connected batteries 13',13'', the +pole of battery 13', closed contacts 29,31, conductor 32, resistor 14, conductor 33 through light-emitter 8, back through conductor 34, to the negative pole of battery 13'' via contact spring 36.

The light emitter 8 is advantageously a red high-intensity light emitting diode, preferably having a lens 37 of a diameter of $\frac{1}{4}''$ that focuses a beam of light at the eyes of the golf player as shown in FIG. 1. The light emitter 8 is mounted on the tip of a curved tubular light extender 38 which places the light 8 at the back side of the club head 4 in vertical alignment with the so-called "sweet spot" on the front drive side of the club head 4, shown as a dotted line circle 39 in FIG. 3.

Figure 9A:
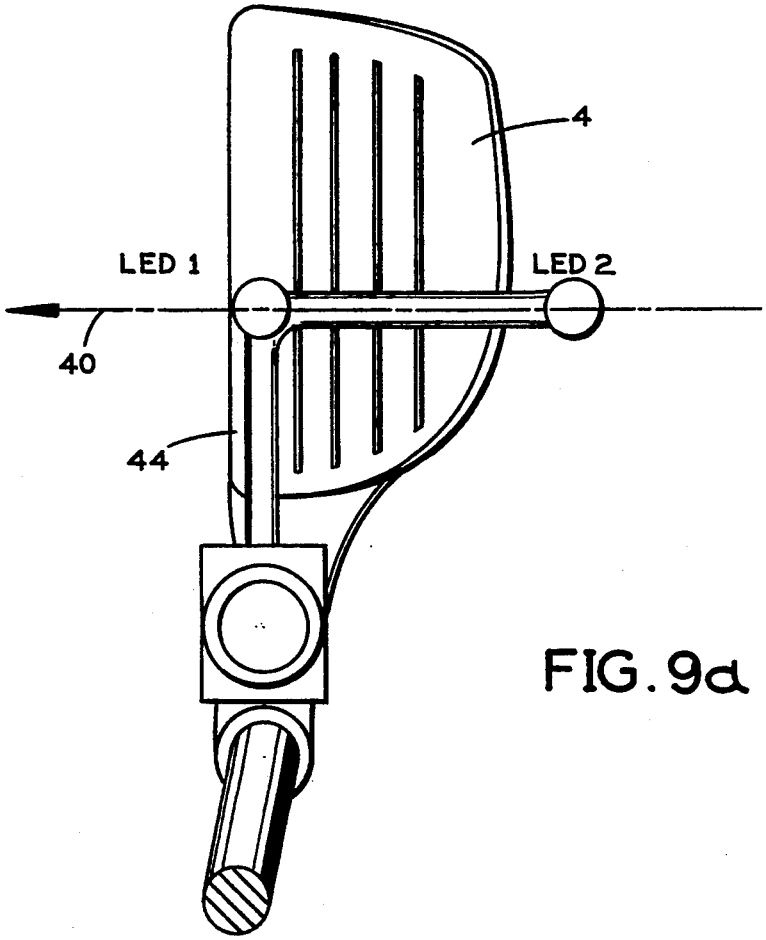
FIG. 9*b*** is a diagrammatic view of two light traces as seen by a player during a swing with the club with two lights.
Figure 9B:
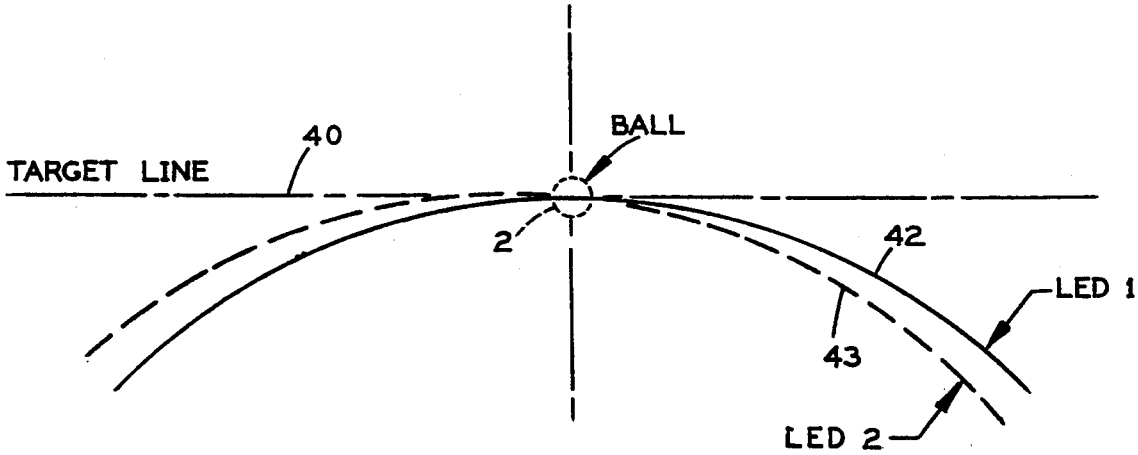

In another version of the invention shown in FIG. **9*a*, two light emitters LED1 and LED2 are connected together and to contact 29 of FIG. 4 so that they are activated simultaneously when contact 29 engages contact 31. Light emitters LED1 and LED2 are positioned in line with the target line 40 indicating the intended direction of the ball upon impact with the face 44 of the club head 4. Each light LED1 and LED2 will indicate a light trace to the player during the swing of the club. At any point during the down swing at which the face of the club is not at a right angle (i.e. square) to the line 40, the golfer will see two distinct light traces. As the club comes to the position at which the club face comes to the square position as in FIG. 9*b***, these two traces will converge into a single line until the club face moves through the swing and the two traces reappear as individual traces.

FIG. **9*b* shows the respective traces 42,43 for lights LED1 and LED2, with the latter trace shown in a phantom line, and the trace for LED1 shown in a full line. As seen, the trace lines 42,43** converge at the point the club is square with the target line.

According to one especially advantageous feature of the invention the light emitter is activated at an early point of the swing, i.e. at the beginning of the swing speed, e.g. point 39*a* shown in FIG. 1, so that the light in the club head during the swing forms a light trace of a width of about ¼" as viewed by the player. In the practice of simulating driving of the ball, a line 40 coextensive with line A in FIG. 1 may be laid down on the ground or on a mat 41 on which the player is addressing the ball, which indicates to the player the intended direction of the ball. If the swing is straight in the direction of line A, the light trace will coincide with the line 40 as viewed by the player. Any deviation in the direction from the line 40 will be clearly visible to the player as the light trace will form an angle with the line A, and will help him or her to make the proper adjustments in the performance of the swing in order to develop a more accurate swing technique.

In the version of the practice device shown in FIG. 4, having only a single light 8, the contact 29 may be adjusted such that the light 8 is switched on at a point early in the swing to indicate by its light trace the direction of the swing.

I claim:

1. A golf practice device for attachment to a shaft of a golf club having a head having a drive side for engaging a golf ball, the device comprising swing speed sensing means for sensing swing speed of said golf club, light emitting means coupled to and activated by said swing speed sensing means for indicating a swing speed being equal to at least a given swing speed, and wherein said light emitting means form a visible light path indicating swing direction, and said swing speed sensing means including a plurality of weights of different masses calibrated to activate said light emitting means at different predetermined club head speeds.

2. A golf practice device according to claim 1, wherein said light emitting means include a light beam adapted to be directed to the eye of the player swinging the golf club.

3. A golf club practice device according to claim 1, including an inertial mass composed of said calibrated weights in said swing speed sensing means, a first switch in said speed sensing means coupled to said inertial mass to activate said switch with a centrifugal force generated by said inertial mass during the swing.

4. A golf club practice device ,according to claim 3, wherein said device further comprises a second light emitter connected to said first switch, said second light emitter spaced apart from said first light emitter, and disposed in direction from said first light emitter on a line indicating the direction of a golf ball driven by said golf club.

5. A golf practice device according to claim 4, including a mat having a target line thereon and a simulated golf ball on said target line.

6. A golf practice device according to claim 1, wherein said first switch is a snap switch.

7. A golf club practice device according to claim 1, including an electric power source connected to said light emitting means via said first switch.

8. A golf club practice device according to claim 7, wherein said light emitting means include at least a first light emitting diode.

9. A golf practice device according to claim 8, further comprising in said device a curved tubular light extender, said light extender having a distal end for supporting at least said first light emitting diode in vertical alignment with a sweet spot on the drive side of the club head.

10. A golf practice device according to claim 1, including said golf club head having a face side for impacting a golf ball, wherein said face side has a sweet spot, and wherein said light emitting means include a first light emitter disposed above the club head in alignment with said sweet spot.

11. A golf practice device according to claim 1, including a clip on said practice device for detachably attaching said practice device to the shaft of the golf club.

12. A golf practice device according to claim 1, including an upper tubular part on said device for containing said calibrated weights, and a removable cap on said tubular part for accessing said calibrated weights.

13. A golf practice device according to claim 12, wherein said calibrated weights are axially slidable in said tubular part.

14. A golf practice device according to claim 12, wherein said plurality of calibrated weights have differently weighted masses, each of said weights adapted to be slidably inserted in said tubular part.

15. A golf practice device according to claim 1, wherein said calibrated weights are calibrated in terms of yardage.

* * * * *